US009701526B2

(12) United States Patent
Benz

(10) Patent No.: US 9,701,526 B2
(45) Date of Patent: Jul. 11, 2017

(54) LIFTING APPARATUS FOR VEHICLES

(71) Applicant: Gerhard Finkbeiner, Freudenstadt (DE)

(72) Inventor: Dieter Benz, Alpirsbach (DE)

(73) Assignee: Gerhard Finkbeiner, Freudenstadt (DE)

( * ) Notice: Subject to any disclaimer, the term of this patent is extended or adjusted under 35 U.S.C. 154(b) by 0 days.

(21) Appl. No.: 14/899,160

(22) PCT Filed: Jun. 27, 2014

(86) PCT No.: PCT/EP2014/063732

§ 371 (c)(1),
(2) Date: Dec. 17, 2015

(87) PCT Pub. No.: WO2014/207217

PCT Pub. Date: Dec. 31, 2014

(65) Prior Publication Data

US 2016/0145085 A1 May 26, 2016

(30) Foreign Application Priority Data

Jun. 27, 2013 (DE) ..... 20 2013 102 803

(51) Int. Cl.
*B66F 5/00* (2006.01)
*B66F 13/00* (2006.01)
(Continued)

(52) U.S. Cl.
CPC ..... *B66F 13/00* (2013.01); *B66F 3/02* (2013.01); *B66F 3/46* (2013.01); *B66F 7/025* (2013.01); *B66F 7/04* (2013.01); *B66F 7/28* (2013.01)

(58) Field of Classification Search
CPC .... B66F 13/00; B66F 3/02; B66F 3/46; B66F 7/28; B66F 7/04; B66F 7/02
See application file for complete search history.

(56) References Cited

U.S. PATENT DOCUMENTS 4,679,660 A 7/1987 Suzuki
4,715,477 A 12/1987 Suzuki
(Continued)

FOREIGN PATENT DOCUMENTS

CN 1406796 A 4/2003
DE 18 16 919 A1 7/1970
(Continued)

OTHER PUBLICATIONS

International Search Report for corresponding patent application No. PCT/EP2014/063732 dated Oct. 28, 2014.

*Primary Examiner* — Lee D Wilson
(74) *Attorney, Agent, or Firm* — Renner, Otto, Boisselle & Sklar, LLP

(57) ABSTRACT

The invention relates to a lifting apparatus (11) for lifting and lowering vehicles, with a support (17) which is movable up and down and on which at least one length-adjustable supporting arm (21) is mounted on a lower section (19) of the support (17) so as to be pivotable about a pivot axis (22), and a free end of the supporting arm (21) is movable under the vehicle to the support point of the vehicle, wherein the length-adjustable supporting arm (21) has a supporting arm body (52) which extendably accommodates at least one supporting arm piece (58, 59) forming an extension, wherein the section (19) of the support (17) comprises an upper and lower support section (48, 49), with respect to which the supporting arm body (52) is mounted rotatably by means of a pivoting arrangement (50) which is formed by an upper and lower pivot bearing (55, 70) which opens up an interior space of the supporting arm body (52) for at least one supporting arm piece (58, 59) which is positionable therein.

17 Claims, 10 Drawing Sheets

Figure 1:
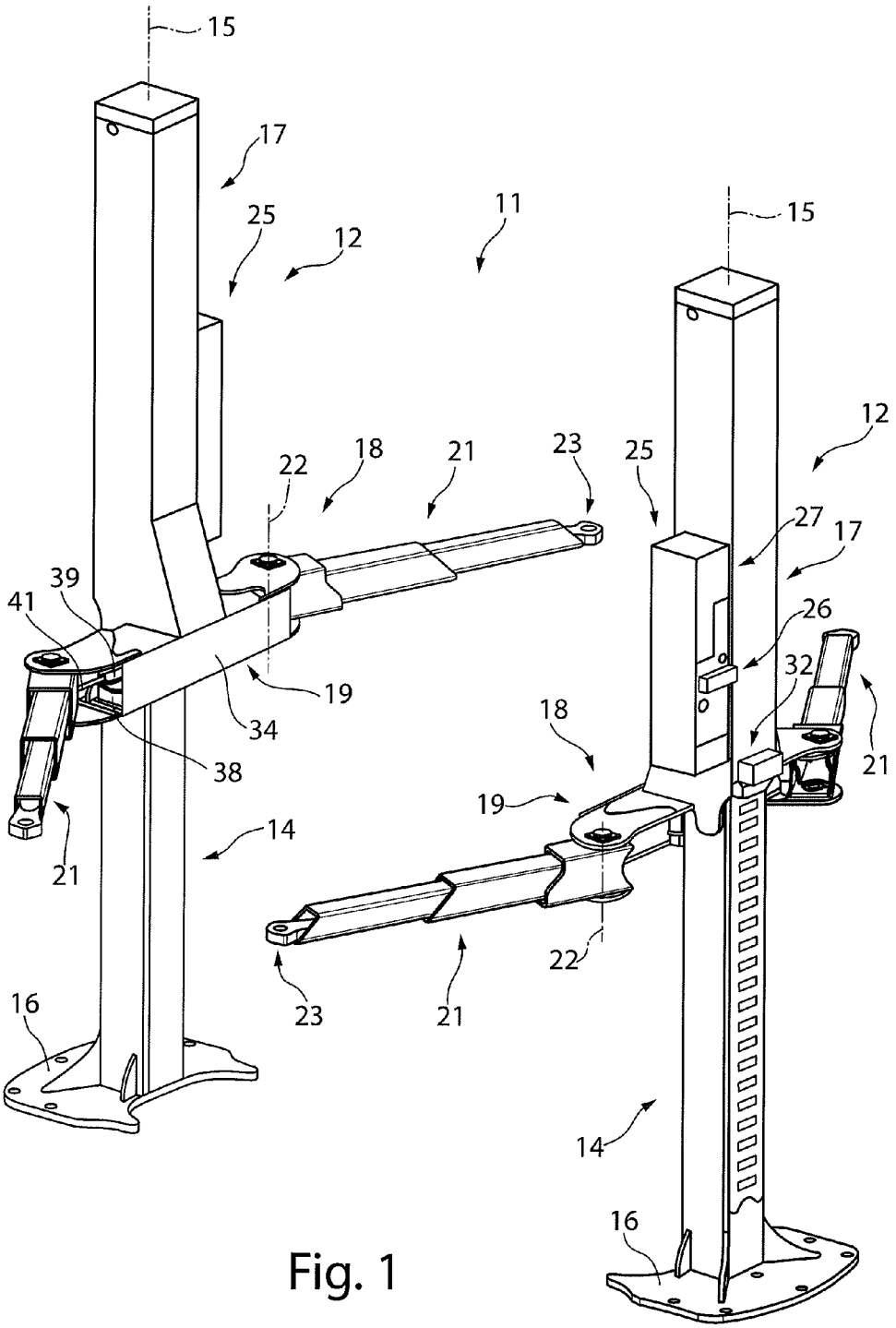

(51) Int. Cl.

| | |
|---|---|
| ***B66F 7/02*** | (2006.01) |
| ***B66F 7/04*** | (2006.01) |
| ***B66F 7/28*** | (2006.01) |
| ***B66F 3/46*** | (2006.01) |
| ***B66F 3/02*** | (2006.01) |

(56) References Cited

U.S. PATENT DOCUMENTS

| | | | | |
|---|---|---|---|---|
| 4,776,569 | A * | 10/1988 | Nestel-Eichhausen | B66F 7/02 254/133 R |
| 4,825,977 | A * | 5/1989 | Isogai | B66F 7/02 187/203 |
| 5,009,287 | A * | 4/1991 | Starr | B66F 7/04 187/213 |
| 5,803,206 | A * | 9/1998 | Halstead | B66F 7/04 187/208 |
| 6,279,685 | B1 * | 8/2001 | Kogan | B66F 7/28 187/203 |
| 2004/0011594 | A1 * | 1/2004 | Stewart | B66F 7/28 187/213 |
| 2013/0233651 | A1 * | 9/2013 | Kritzer | B66F 7/20 187/208 |
| 2016/0145085 | A1 * | 5/2016 | Benz | B66F 7/025 254/134 |

FOREIGN PATENT DOCUMENTS

| | | | |
|---|---|---|---|
| DE | 76 19 866 | U | 11/1976 |
| DE | 27 42 518 | A1 | 3/1979 |
| DE | 199 59 835 | A1 | 6/2001 |
| EP | 1 357 079 | A2 | 10/2003 |
| FR | 2 302 272 | A1 | 9/1976 |
| FR | 2 356 343 | A7 | 1/1978 |
| JP | S52 49544 | A | 4/1977 |
| JP | 2000289586 | A | 10/2000 |
| JP | 2002128481 | A | 5/2002 |
| JP | 2003081583 | A | 3/2003 |
| TW | 522 106 | B | 3/2003 |

* cited by examiner

LIFTING APPARATUS FOR VEHICLES

The invention relates to a lifting device for lifting and lowering vehicles having a support which is able to move up and down, on which at least one longitudinally adjustable support arm is mounted to be pivotable around a pivot axis on the support.

Such a lifting device is known, for example, from DE 18 16 919 A1. This two-column lifting platform has a first support arm, which is longitudinally adjustable or extendable, on a support, as well as a second support arm on the same support, which is not only extendable, but also has arm pieces which are pivotable with respect to the support. The extension of the pivotable support arm is limited by the pivot axis due to the arrangement fitting into itself telescopically, said pivot axis connecting the first and second support arm pieces to each other and extending along the pivoting jaws.

Furthermore, a lifting platform for motor vehicles is known from EP 1 357 079 A2 which has two support arms which are arranged to be pivotable on a support, wherein the support arms which are arranged to be pivotable are formed to be telescopic and are extendable. For the compact arrangement of the lifting platform in the unused state, the longitudinally adjustable support arm is formed by two support arm pieces which are arranged to be pivotable with respect to each other, wherein a first pivot axis connects the support to the first support arm piece and a second pivot axis connects the second support arm piece to the first support arm piece. The pivoting of the first and second support arm pieces one on the other is possible in that the second pivot axis is positioned to be offset to the second support arm piece in order to strike the first support arm piece. Due to the offset in the transverse direction, it is possible for them to lie one on the other in parallel. The support arm piece provided as an extension corresponds substantially to the length of the second support arm piece such that only the load receiver protrudes compared to the second support arm section. This arrangement has the disadvantage, due to the offset arrangement of the pivot axis which lies outside of the second support arm piece, that additional stiffening elements must be provided in order to create a sufficiently stiff connection between the second support arm section and the first support arm section in order to be able to receive the loads of vehicles.

The object of the invention is to create a lifting device for vehicles, which enables a compact construction and larger adjustment region of the support arm and therefore a larger working region.

This object is solved by the lifting device having the features of claim 1. Further advantageous embodiments are specified in the further claims.

Due to the design of the lifting device with a support which comprises an upper and a lower support section between which a support arm body is mounted to be pivotable due to a pivot arrangement which is formed by an upper and a lower pivot bearing, such that the pivot axis runs through both the support arm body and the support sections, but the inner space of the support arm body is not crossed by a pivot pin, it is enabled that the inner space of the support arm body is free and at least one extendable support arm piece is able to be arranged therein. Therefore, both a statically stable arrangement is created which can receive high loads and a compact construction can be achieved. Additionally, due to the design of the free inner space in the support arm body, a larger adjustment region or extension region for the at least one support arm piece can be created, compared to a pin which is known from prior art and which extends through the support arm body completely and which represents a restriction in the traversing movement.

Preferably it is provided that the upper and lower pivot bearings lie in a mutual pivot axis which extends through the inner space of the support arm body. A compact construction as well as an arrangement which is optimised for receiving force can therefore be created, wherein at the same time it is still enabled that an inner space of the support arm body is freely accessible for a support arm piece in order to position this to be displaceable therein.

Preferably it is provided that at least one pivot bearing is formed as a pivot pin. Such a pivot pin represents a simple structural measure. The at least one support arm piece which forms the extension can thereby also be passed completely through the inner space of the support arm body.

A preferred embodiment of the lifting device provides that the support arm body is mounted to hang on the upper support section of the support using the upper pivot pin. Due to such an arrangement and design of the pivot pin, the friction force during a pivoting movement for the positioning the load receiving element with respect to the support points of the vehicle and a pivoting back into an initial position is considerably reduced.

Furthermore it is preferably provided that the support arm body is guided, aligned to the pivot axis, on the lower support section by the lower pivot pin. Due to the design of the upper pivot pin for the hanging receiving of the support arm body, a guiding of the support arm body is sufficient for the pivotable arrangement with respect to the lower support arm section. A further simplification can thereby be enabled in structural construction.

The support arm body is preferably formed as a box-shaped housing which has an upper housing wall in which a bore is provided for positioning the upper pivot pin, wherein the upper pivot pin engages behind the upper housing wall in the inner space of the support arm body. Therefore, the hanging arrangement can be designed in a simple manner.

The upper pivot pin has a circumferential groove which runs above an upper side of the upper support section, with which a pivot pin retainer engages in an assembly position of the pivot pin with respect to the support section and support arm body. A stable arrangement can therefore be created in a structurally simple manner which also enables a quick disassembly in the event of damage.

The pivot pin retainer is formed to be plate-shaped and comprises a U-shaped retaining section which engages with the groove of the upper pivot pin. A simple insertion movement of the pivot pin retainer into the groove can thereby occur to secure the upper pivot pin, wherein the plate-shaped pivot pin retainer, for example, abuts onto the upper support section and is fixed by a releasable fastening, such as, for example, a screw connection on the upper support section, and secures the upper pivot pin.

For the pivotable arrangement of the support arm body with respect to the upper and lower support section, the upper and lower pivot pins are each inserted from the inner space of the support arm body or from outside or optionally from outside and/or outside into a receiving bore on the upper and lower housing wall of the support arm body and into corresponding bores in the upper and lower support sections. This has the advantage with regard to the upper pivot pin that a pivot pin retainer is provided in a simple manner on the upper side of the support section and a maximum free inner space of the support arm body is provided for the support arm piece guided therein and forming the extension. The same applies for the lower pivot pin which only needs to be inserted and is preferably secured by a clamping, such as, for example, countersunk screws, via the inner space. The lower pivot pin only projects slightly on a lower side compared to the lower support section or is flush with this, such that a maximum lowering movement of the support is maintained.

At least one guide and/or sliding element is provided on each housing wall in the box-shaped housing of the support arm body, using which the support arm piece mounted therein is guided in a traversing manner. A facilitated longitudinal adjustment of the support arm can thereby be enabled. At the same time, the support arm piece is guided to be centred within the support arm body, such that the upper and the lower sections of the support arm piece can be guided past the upper and lower shoulders of the pivot pin which project into the inner space, which extend slightly into the inner space of the support arm body.

Furthermore, it is preferably provided that several support arm pieces are able to be arranged telescopically in the support arm body. Due to the design of the divided pivot pin, so into an upper and lower pivot pin, which release the respective inner space, this telescopic arrangement can be enabled such that the support arm is able to be arranged in an initial position with only a small construction space.

Furthermore, it is preferably provided that a stop to limit an extension movement of the support arms forming the extension is provided on each of the front and/or rear end of the support arm and support arm body, as well as also to secure a retraction movement into an initial position.

The upper and/or lower pivot pin preferably has at least one lubrication channel which is accessible from the outside and leads to the bearing surface. A simple reduction of the friction force can thereby be achieved.

The support arm body has at least one roller guide, in particular a spring-mounted or flexible roller guide, on a housing wall which is to the front or to the rear in the extraction direction of the support arm piece, said roller guide being rendered inoperative in the case of load receiving. The retraction and extension movement of the support arm piece for the transfer into a use position or back into an initial position is thereby facilitated. At the same time, in the case of load receiving, it is ensured that a further traversing movement of the at least one support arm piece which extends or shortens the collecting arm is prevented.

Such a roller guide is preferably also provided on the support arm piece or an extension of the support arm piece, wherein one roller guide is arranged on the extension and a further roller guide is arranged in the support arm piece to work in opposite directions, such that these act in a supporting manner in the case of a relative traversing movement with respect to each other.

The invention as well as further advantageous embodiments and developments of the same are described and explained in more detail below by means of the examples depicted in the drawings. The features to be gleaned from the description and the drawings can be applied individually or together in any combination according to the invention. Here are shown:

FIG. 1 a perspective view of a lifting device forming a two-column lifting platform, FIG. 2 a perspective view onto a support of the lifting device having a telescopic support arm in an initial position, FIG. 3 a perspective view onto a support of the lifting device having a telescopic support arm in a use position, FIG. 4 a perspective view from below onto the telescopic support arm in a use position according to FIG. 3, FIG. 5 a schematic sectional view along a pivot axis between the support arm and the support and FIG. 6 a schematic longitudinal cut of the telescopic support arm in an initial position, FIG. 7 a schematic longitudinal cut of the telescopic support arm in a use position, FIG. 8 a perspective view of a two-column lifting device having a guide rail, FIG. 9 a schematic sectional view for fixing the guide rail to the support arm of the lifting device and FIG. 10 a perspective view of a [lacuna] for receiving a load receiving element adapted to the guide rail on the support arm.

In FIG. 1, by way of example, a two-column lifting platform 11 is depicted perspectively which comprises two lifting devices 12 which are allocated to each other. This lifting device 12 comprises a lifting column 14 which is connected firmly, for example, to a base plate 16 which is connected fixedly to the ground. A support 17 is provided to be able to move up and down along a lifting axis 15 of the lifting device 11. The support 17 receives a load receiving means 18. The load receiving means 18 comprises a housing section 19 which is at least partially closed, on the respective outer ends of which support arms 21 are received to be pivotable around a vertical pivot axis 22. These support arms 21 are formed to be telescopic and have load receiving elements 23 or provisions which lie opposite the pivot axis in order to arrange different load receiving elements 23 exchangeably thereon.

The support 17 furthermore receives a drive device 25. This can be formed electrohydraulically, hydraulically or mechanically and has a hydraulic unit according to the depicted embodiment. This drive device 25 is monitored and controlled by a control 26. For the energy supply, for example, at least one accumulator 27 can be provided. The control 26 advantageously works wirelessly. In particular, a remote control can be provided in order to control the lifting devices 12. In particular, the two lifting devices which are allocated to each other and lie opposite each other communicate wirelessly with each other in order to ensure, for example, a simultaneous initiation of a lifting and lowering movement as well as a mutual monitoring of synchronisation or similar. Alternatively, supply lines and/or control lines can be provided between the two lifting devices 12, such that both control signals and a current supply are enabled via a cable.

The support 17 is formed to be sleeve- or cartridge-shaped and surrounds the lifting column 14. In this arrangement it is therefore provided that the drive spindle or the hydraulic cylinder is arranged for lifting and lowering the support 17 within the lifting column 14. The hydraulic cylinder is supported on one side on a lower end of the lifting column 14 or the base plate 16 and strikes the upper, inner end section of the support 17. To guide the support 17 to the lifting column 14, guide elements 29 lying therebetween are provided which, for example, can be formed as roller or sliding elements or as a combination hereof. Furthermore, a drop guard 32 is provided between the lifting column 14 and the support 17, with which a deactivation or a current shutdown of a holding magnet of the fall guard occurs after controlling a lifting movement of the support 17 and a locking element implements a securing of the adjusted lifting position.

Figure 2:
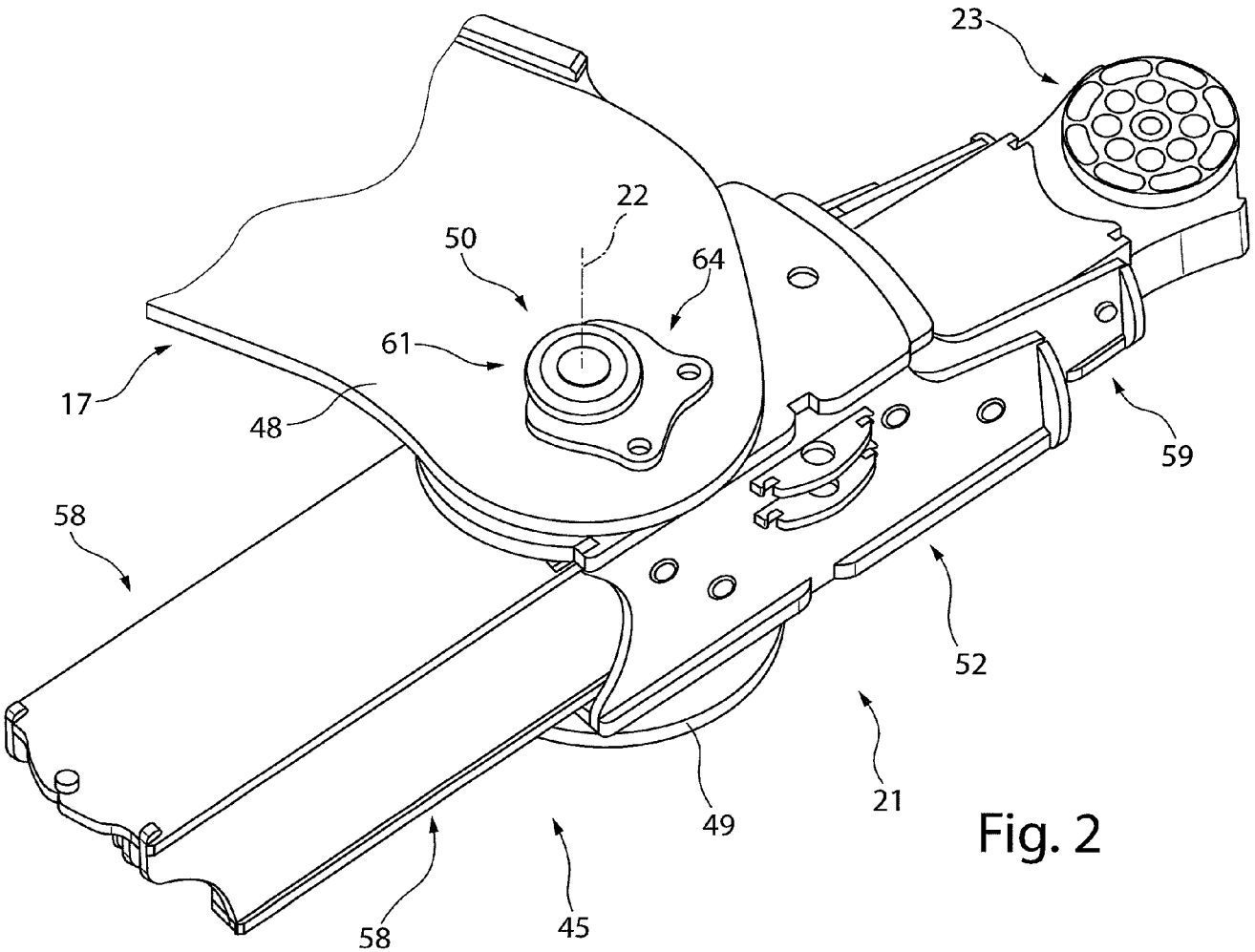

An alternative embodiment of the lifting device 12 provides that the lifting columns have a U-shaped cross-section, within which the support is guided to be able to move up and down, wherein the at least partially closed housing section 19 is arranged on the support 17, analogously to the lifting device 12 according to FIG. 2, in order to receive the support arms 21.

A further alternative embodiment of the lifting device 11 can be that, instead of the lifting column and the support which is able to move up and down, a lifting stamp of a stamping platform is provided, wherein the support is arranged on the upper end of the lifting stamp on which the support arms 21 are provided.

Furthermore, a further alternative embodiment of the lifting device 11 can be provided in which the support which is able to move up and down is moved up and down by means of a half-scissor or double-scissor mechanism which in turn are operated using a hydraulic cylinder, on which the support arm 21 can be arranged.

A front cover 34 is provided on the support 17. A locking device 37 is provided behind this front cover 34 in the housing section 19, said locking device striking the support arm 21. Using this locking device 37, an adjusted pivot position of the support arm 21 can be fixed such that the adjusted pivot position of the support arm 21 with respect to a load or support point remains maintained on the vehicle. The locking device 37 comprises an operable adjustment device 38 which is formed according to the exemplary embodiment as a hydraulic cylinder 39. This hydraulic cylinder 39 comprises a piston rod 41, the outer end of which strikes a bearing surface 42 of the pivotable support arm 21.

The adjustment device 38 can, alternatively to the hydraulic cylinder 39, comprise a pneumatically driven or electrically or electromagnetically driven positioning device 38 and/or a reciprocating piston. Alternatively, a linear drive can also be provided which in turn can be driven electrically, pneumatically or hydraulically. A positioning movement or traversing movement of the positioning device 38 can be controlled by a switching valve or a switching contact which is activated in particular if the support 17 lies, in a lowered position, on the ground in order to transfer the pivotable support arms 21 from a use position in which the load receiving elements 23 are allocated to the support points of the vehicle, into a non-use position and vice versa. In the non-use position, the support arms 21 are pivoted out of the driving region of the vehicle such that this can be driven out in one movement. Alternatively, the positioning movement of the positioning device 38 can also be driven only via a control device of the lifting device 12.

In FIG. 2, a schematically enlarged view of a pivot region between the support 17 and the support arm 21 which is arranged to be pivotable with respect to this is depicted, wherein the support arm 21 is depicted in a retracted position or initial position 45.

Figure 3:
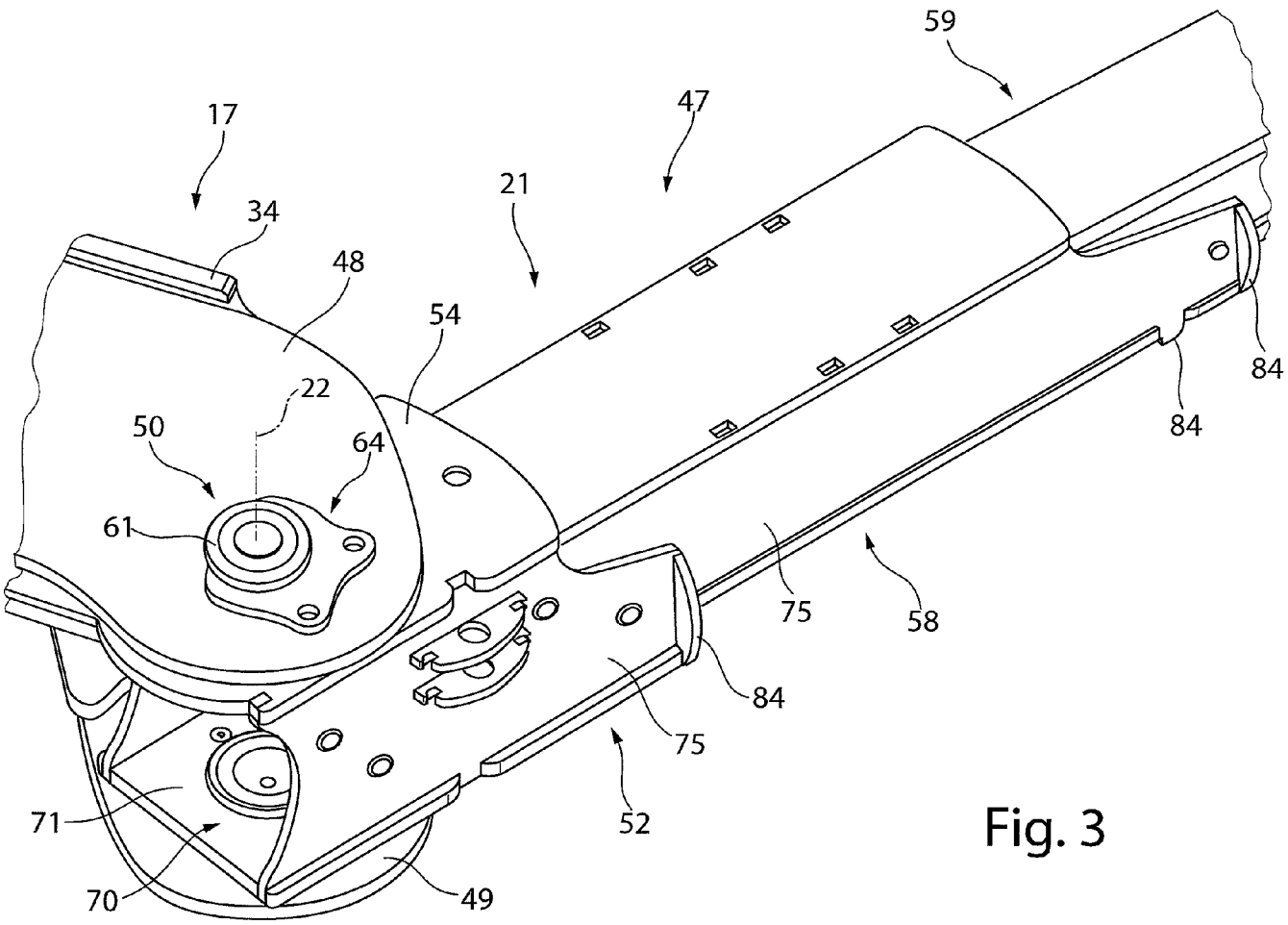

In FIG. 3, the pivotable support arm 21 is depicted in an extended position or use position 47.

An upper and lower support section 48, 49 is provided on the support 17, which are preferably formed to be plate-shaped and form a U-shaped receiving region, such that the pivotable support arm 21 is mounted between the upper and lower support sections 48, 49. The pivot axis 22 extends through the upper and lower support arm sections 48, 49, as well as through the support arm 21, wherein a pivot arrangement 50 is provided which has a two-part pivot bearing (55, 70), such that the extendable support arm 21 can cross the pivot axis 22, which means that the pivotable support arm 21 is also able to be guided between the upper pivot bearing 55 and the lower pivot bearing 70.

The pivotable support arm 21 comprises a support arm body 52 which has a box-shaped housing 53. The upper pivot bearing 55 is formed between the upper support section 49 and an upper housing wall 54 of the support arm body 52. In the same way, a lower pivot bearing 70 is provided between a lower housing wall 72 of the support arm body 52 and the lower support section 49, wherein the two pivot bearings 55 and 70 lie in the same pivot axis 22, yet are separated from each other. An inner space in the box-shaped housing 53 of the support arm body 52 is thereby released such that, for example, a first support arm piece 58 is received in the housing 53 and crosses this. The first support arm piece 58 is completely traversable with respect to the housing 53. In the first support arm piece 58, a further or second support arm piece 59 can be provided, on the outer end of which the load receiving element 23 is able to be arranged. Further support arm pieces can also be nested one within the other, such that the longitudinally adjustable support arm 21 is formed to be telescopic.

In an initial position 45 of the pivotable support arm 21, the first and second support arm pieces 58, 59 are positioned one within the other in a telescopic manner and are arranged in a retracted position with respect to the support arm body 52, as is depicted in FIG. 2. Here, the pivotable support arm 21 can also be pivoted further laterally outwards with respect to the load receiving element 23 such that a rear end of the first support arm piece 58 can be pivoted to close onto the lifting column 14 in order to enable a space-saving arrangement and compact construction unit during non-use.

In the case of an extended support arm 21 according to FIG. 3, a maximum pivot region of the support arm 21 with respect to the support 17 is provided in order to occupy the position with respect to the respective support points on the vehicle.

Figure 4:
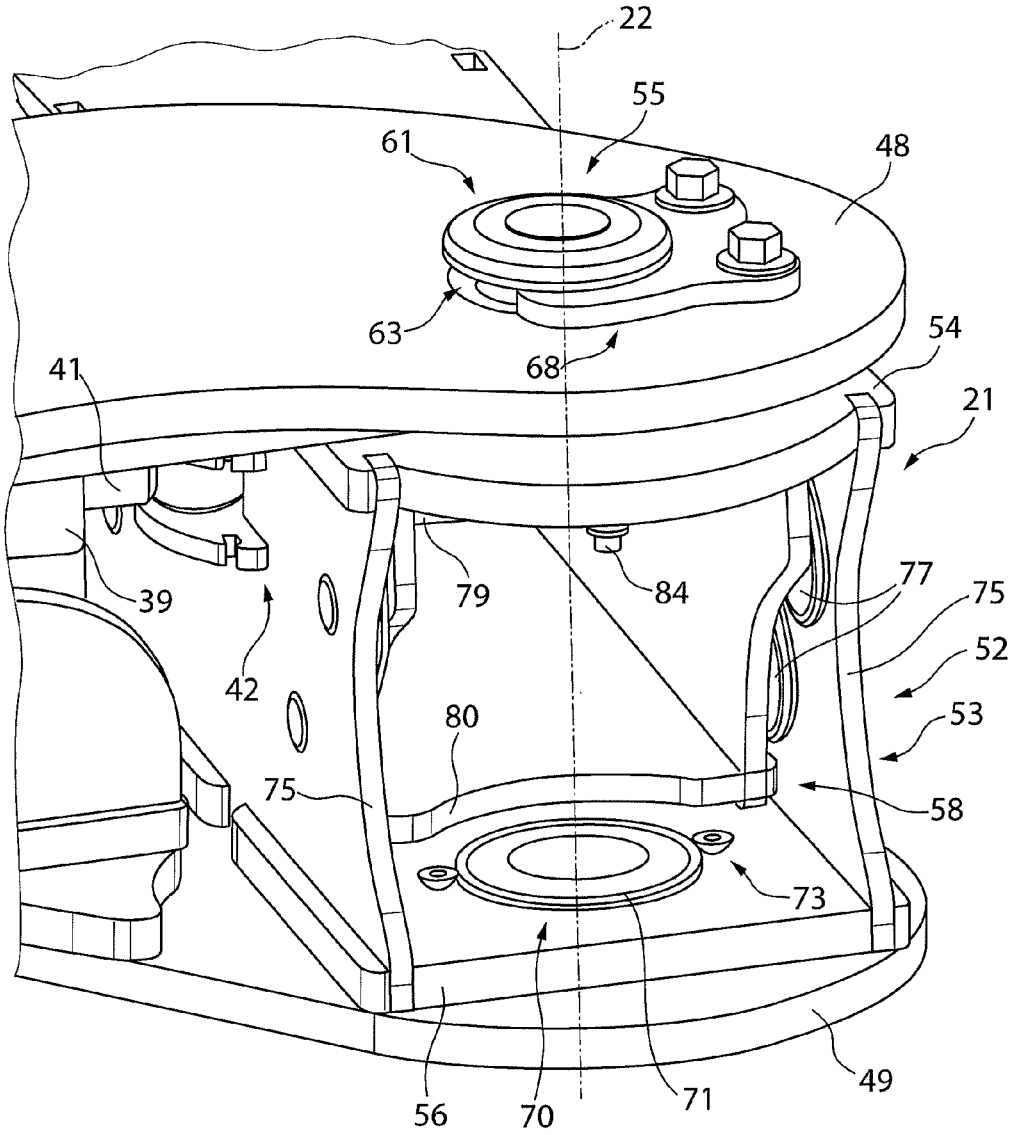

In FIG. 4, a perspective view onto a partially extended support arm 21 is depicted.

Figure 5:
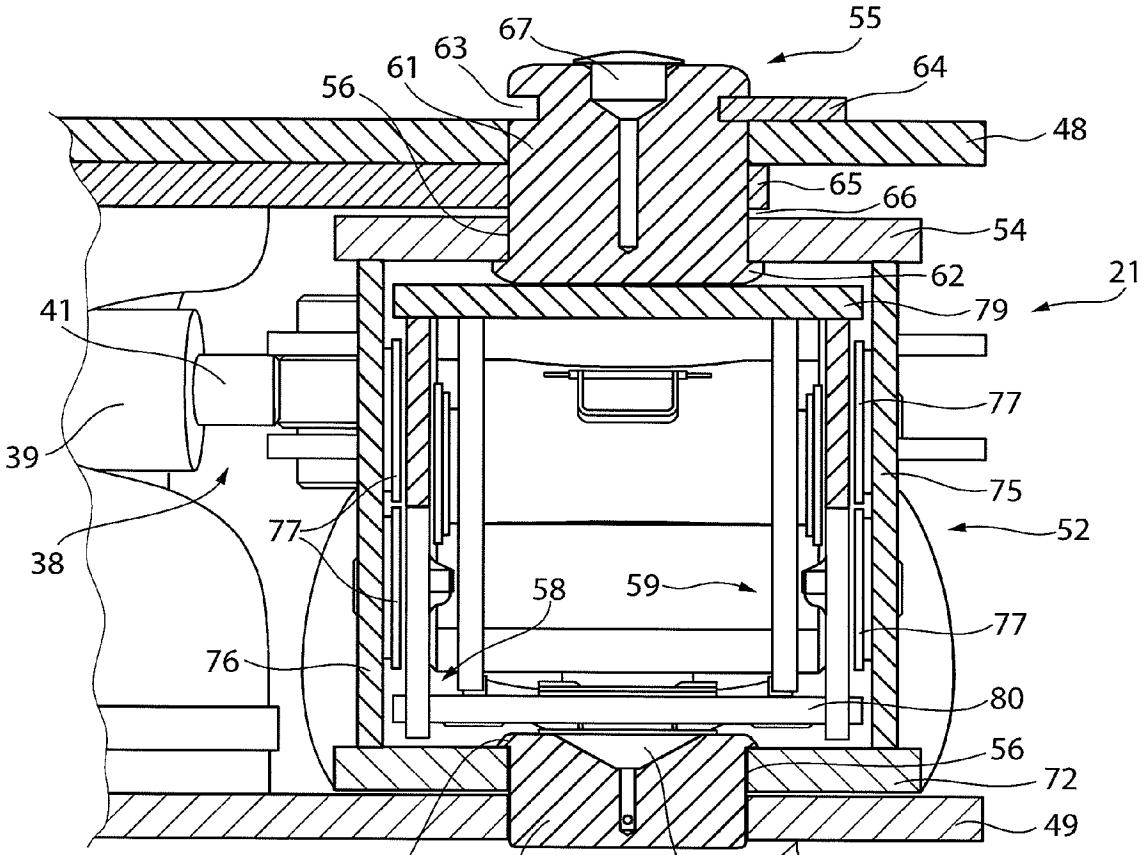

In FIG. 5, a schematic sectional view through the pivot axis 22 of the pivot arrangement 50 is depicted.

The box-shaped housing 53 is preferably composed of sheet metal cuttings and preferably welded together, such that a square inner space is formed. An upper housing wall 54 is aligned in parallel to the upper support section 49, wherein a bore 56 is introduced in each of the housing wall 54 and the support section 49 such that the upper pivot pin 61 forms an upper pivot bearing 55 for the support arm body 52 with respect to the upper support section 48. In this instance, it can be provided that the pivot pin 61 is inserted from the inner space into the support arm body 52 such that a shoulder 62 abuts onto an inner side of the upper housing wall 54 and engages behind this. A circumferential groove 63 is provided opposite in the pivot pin 61 which extends to be adjacent to the upper support sections 48 such that a pivot pin retainer 64 can engage therewith in order to fix the pivot pin 61 with respect to the upper support section 48. The support arm 21, in particular the support arm body 52, is therefore received to be hanging with respect to the upper support section 48, which means that a smaller gap 66 is formed between the upper housing wall 54 and the upper support section 48 or stiffening element 65 allocated to an upper support section 48. A reduced friction of the pivot bearing 55 can be achieved using this arrangement.

Preferably, a lubricant supply 67 is provided in the upper pivot pin 61, which means that lubricant can be introduced from the outside such that this can be supplied through an axial and at least one radial channel up to the region of the bearing surface between the upper housing wall 54 and the shoulder 62 of the pivot pin 61.

The pivot pin retainer 64 is preferably also formed as a plate-shaped sheet metal part which has a U-shaped retaining section 68 on the upper support section 48 which engages with the groove 63. To fasten the pivot pin retainer 64, a screw connection can be provided, as is depicted in FIG. 4.

The support arm body 52 is mounted rotatably with respect to the lower support section 49 using a lower pivot pin 71, wherein the pivot pin 71 can also be able to be inserted from the inside into the support arm body 52 and extends through a bore 56 in the lower housing wall 72 and through a complementary bore 56 in the lower support section 49. This pivot pin 71 in turn has a shoulder 62 which abuts onto the inner side of the lower housing wall 72. The pivot pin 71 is formed to be cylindrical and serves as a guide of the support arm body 52 to the lower support section 49. To secure the lower pivot pin 71, a screw connection 73 can, for example, be provided. This lower pivot pin 71 can also have a lubricant supply 67. Preferably, a lower side of the pivot pin 71 is provided flush to a lower side 74 of the lower support section 49, such that this lower side 74 of the lower support section 49 can lie on the base or the ground together with the support 17.

Due to the hanging receiving of the support arm body 52 with respect to the upper support section 48, the lower pivot bearing 70 can be formed in a simplified manner such that this serves only to secure the support arm body 52 with respect to the pivotable arrangement around the pivot axis 22, which means that a gap is likewise provided between the lower housing wall 72 and the lower support section 49, whereby the friction is in turn reduced.

Preferably, the two pivot pins 61, 71 are formed to be the same in diameter, whereby a simplified production of the support arm body 52 is also enabled with regard to the upper and lower housing wall 54, 72. Alternatively, the upper pivot pin can also be formed to be larger.

Guide and/or sliding elements 77 are preferably provided on each housing wall 54, 72, 75, 76 to guide the first support arm piece 58 in the support arm body 52. A housing 53 of the first support arm piece 58 which is preferably also formed to be box-shaped is thereby received and guided centrally with respect to the support arm body 52, such that an upper wall section 79 and lower wall section 80 of the first support arm piece 58 can be guided past the shoulder 62 of the upper pivot pin 61 as well as the shoulder 62 of the lower pivot pin 71 in order to be able to occupy a use position 47 according to FIG. 2.

Figure 6:
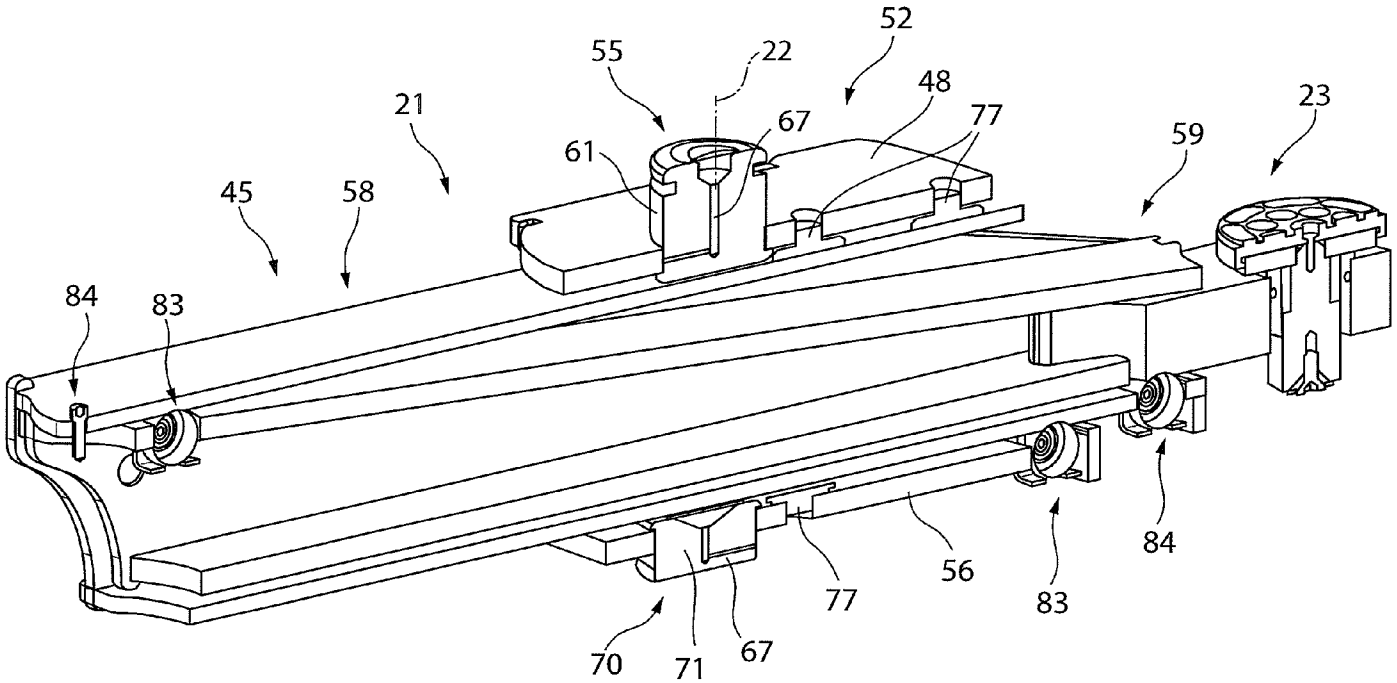

In FIG. 6, a longitudinal cut of the pivotable support arm 21 is depicted in the initial position 45 according to FIG. 2.

Figure 7:
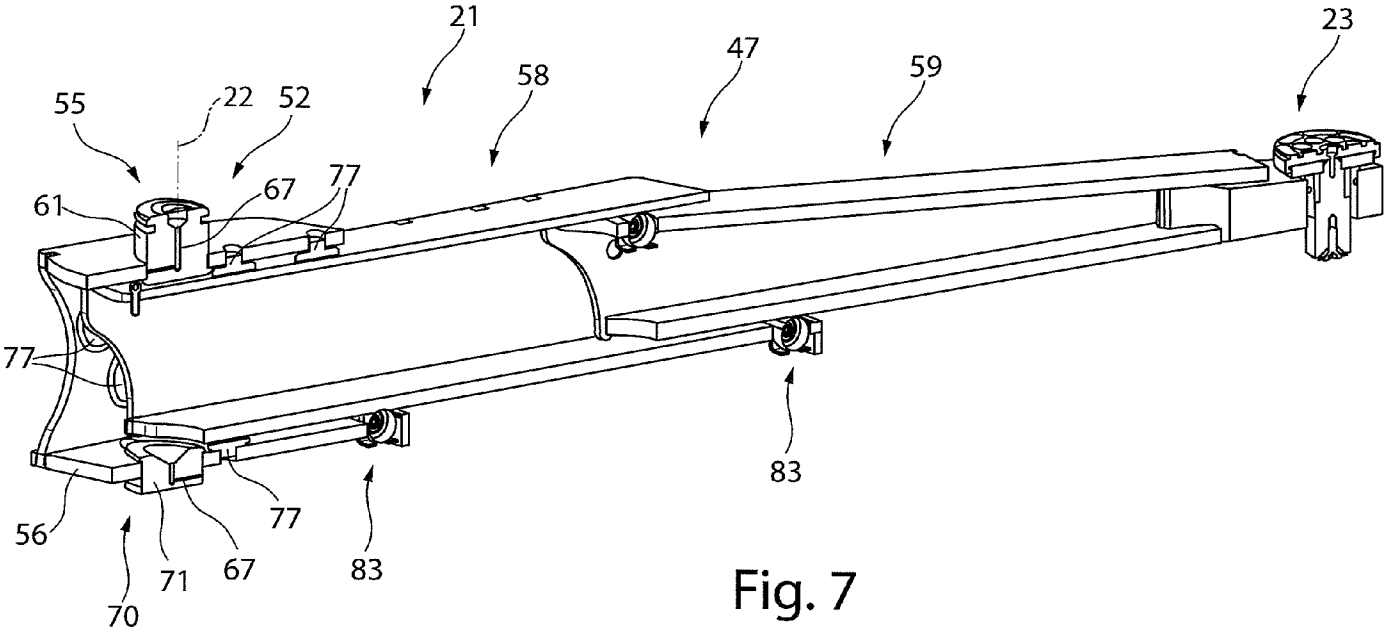

FIG. 7 shows a longitudinal cut of the pivotable support arm 21 in a use position 47 according to FIG. 3. This longitudinally adjustable support arm 21 comprises the support arm body 52, the first support arm piece 58 and the second support arm piece 59 on the outer end of which the load receiving element 23 is able to be inserted. It is understood that several support arm pieces 58, 59 can also be provided.

From FIG. 7, a roller guide 83 is provided in addition to the guide and/or sliding elements 77 for the facilitated displaceable arrangement of the first support arm piece 58 with respect to the support arm body 52, said roller guide 83 being arranged on a front end, opposite which the second support arm piece 59 is extractable with respect to the first support arm piece 58. The second support arm piece 59 advantageously also has such a roller guide 83 which is provided, however, on an inner upper or rear upper end. A facilitated extraction of the second support arm piece 59 with respect to the first support arm piece 58 is thereby enabled, as is clear in the comparison of FIGS. 6 and 7.

Such a roller guide 83 can likewise be provided on the support arm body 52 with regard to the extraction direction of the support arm piece 58, 59. These roller guides 83 acts in a supporting manner during retraction and extension of the support arm pieces 58, 59, but do not exert a load on the load receiving element 23. As soon as the load receiving element 23 strikes a support point of the vehicle, these roller guides 83, which have a flexible bearing or spring bearing, are loaded such that the support arm pieces 58, 59 occupy an arrangement which abuts onto each other firmly with respect to each other, as well as the support arm piece 58 with respect to the support arm body 52.

It is obvious from the longitudinal cut of the extendable support arm 21 through the pivot axis 22 that at least the first support arm piece 48 crosses the pivot axis 22. Therefore a compact construction can be created in which the lever ratios between the support 17 and the pivotable receiver of the support arm 21 can also be kept low.

The retraction and extension movements of the first and second support arm pieces 58, 59 are limited by respective stops 84. For example, a stop 84 is provided on the first support arm piece 58 on a rear upper end, which is limited by the shoulder 62 of the pivot pin 61 in an extracted position of the first support arm piece 58. A retraction movement of the first support arm piece 58 with respect to the support arm body 52 is, for example, limited by the stops 84 provided on the side wall 75 (FIG. 3). The extraction movement of the second support arm piece 49 is limited by the stop 84 depicted, for example, as a screw in the side wall 75 of the first support arm piece 58.

Figure 8:
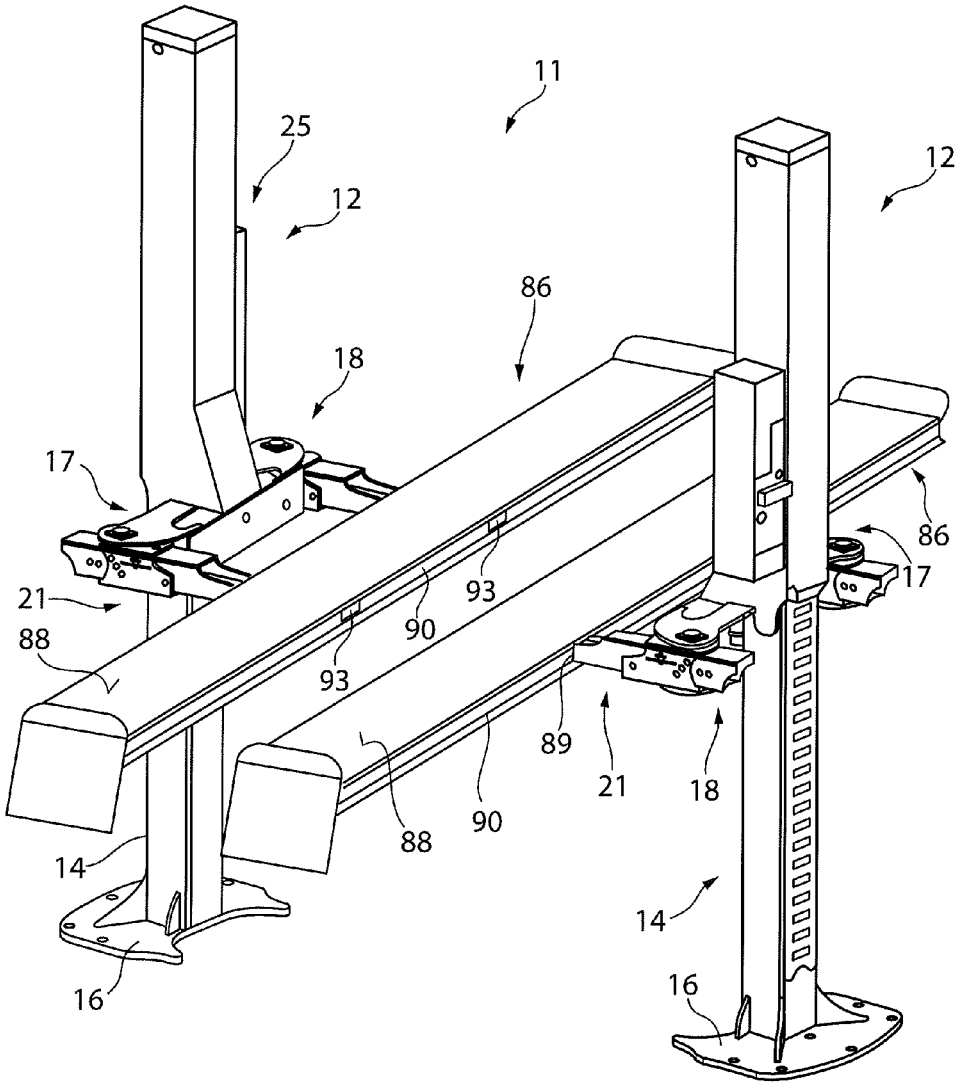

In FIG. 8, an application example of a two-column lifting platform 11 is depicted in which the support arms 21 of each lifting device 12 receive a guide rail 86. In this embodiment, for example, the support arm 21 comprises a support arm base body 52 as well as a first support arm piece 58 which is able to be received displaceably therein. The two support arms 21 are aligned in parallel to each other and receive guide rails 86 via the load receiving elements 23 thereof. Due to the design of the support arm 21 according to, for example, a first support arm piece 58, the spacing of the guide rails 86 which lie opposite each other can be adjustable to a track width of a vehicle to be lifted in a simple manner. The support arm 21 can alternatively also comprise two or more support arm pieces. It is also possible that the load receiving element 23 is fastened directly on the support arm body 52.

Incidentally, one of the embodiments described above for a lifting device 12 can also be used to receive a guide rail 86.

Figure 9:
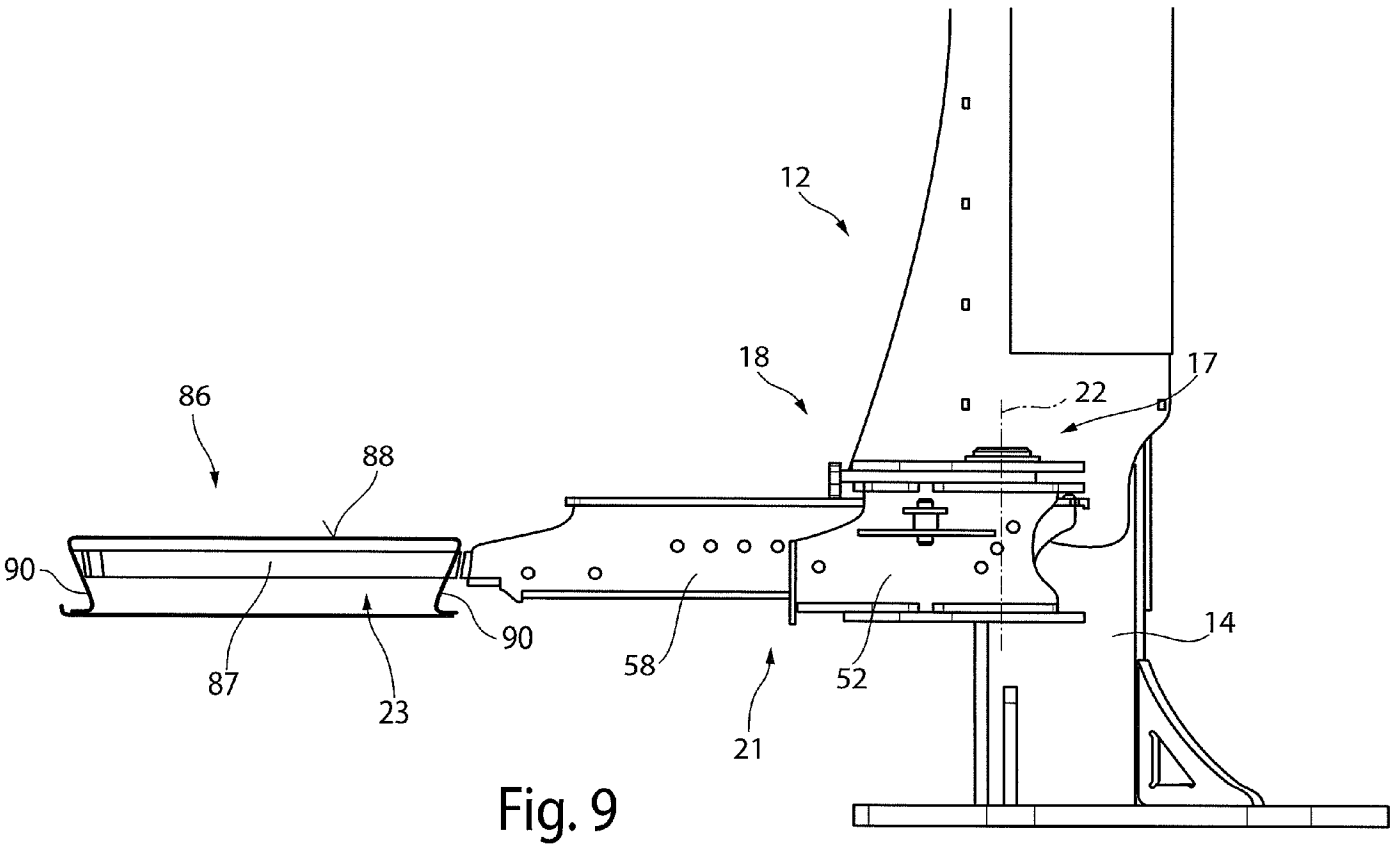
Figure 10:
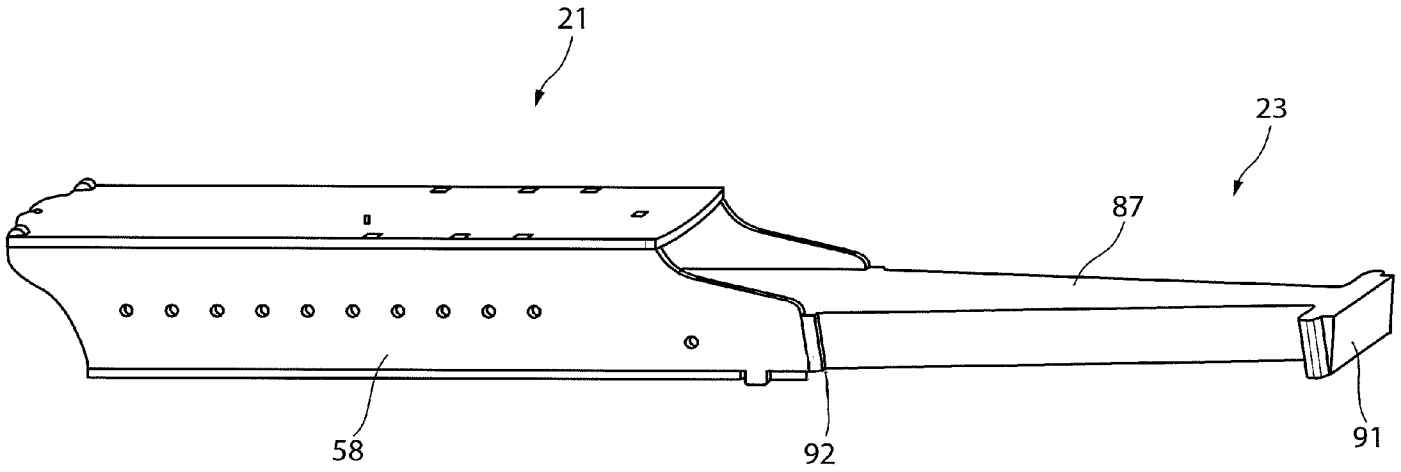

FIG. 9 shows a schematic side view of the support arm 21 and the guide rail 86 arranged thereon. A structural, simple receiving is thereby provided in which the load receiving element 23, as is depicted in FIG. 10, comprises an extended load arm 87 which enables a drive-on surface 88 of the guide rail 86 to be able to be reached under. The load space 87 extends completely over the width of the drive-on surface 88 or substantially over the width of the drive-on surface 88. The depicted embodiment of the guide rail 86 has, for example, an omega-shaped cross-section and is advantageously formed as a sheet metal bending part such that the load arm 87 is able to be implemented in a simple manner in openings 89 on the lateral framing 90 and is fixed on the opposite framing 90 by means of a fastening plate and a fastening means 93. In an alternative structural construction of a guide rail 86, the load receiving element 23 can also strike the lower side of the guide rail 86.

The load receiving element 23 is adapted for the defined receiving of the guide rail 86 in such a way that a first contact surface 91 (FIG. 10) is provided on the front-side end of the load arm 87 of the load receiving element 23 which is adapted to the inclination of the lateral framing 90. On the end of the load receiving element 23 which points towards the support arm 21, a second contact surface 92 is provided which strikes an outer side of the lateral framing 90 such that, due to such an arrangement, a defined contact and positioning of the guide rail 86 with respect to the support arm 21 is enabled via the support surfaces 91 and 92.

The two-column lifting platform 11 depicted in FIG. 8 receives a guide rail 86 which is provided for lifting and lowering, for example, passenger vehicles or transporters. If longer vehicles are to be lifted, a four-column lifting platform can, for example, also be provided in which two lifting devices 12 strike a long guide rail 86 with the support arms 21 thereof at a distance to each other.

Due to the design of the support arm 21 which is arranged to be pivotable with respect to the support 17, and for example receives a first support arm piece 58 displaceably in the support arm body 52, it is also enabled that different support arm pieces 58 can be used with load receiving elements 23 formed to deviate from each other in order to enable a quick and simple equipping of the lifting device 12 in different application cases. Therefore, for example, instead of the telescopic support arm 21 according to FIG. 1, in the case of use of a support arm 21 according to FIG. 10, a simple equipping on a two-column guide rail lifting platform can be enabled.

The invention claimed is:

1. A lifting device for lifting and lowering vehicles comprising:

a support which is movable up and down;

at least one longitudinally adjustable support arm that is mounted on the support and is pivotable around a pivot axis on the support, wherein the support arm has a free end that is movable under the vehicle with respect to a support point of the vehicle, wherein the longitudinally adjustable support arm has a support arm body;

at least one support arm piece that is received by the support arm body and forms an extension in an extractable manner; and a pivot arrangement, wherein the support comprises an upper and lower support section with respect to which the support arm body is mounted rotatably using the pivot arrangement which is formed by an upper and lower pivot bearing which define an inner space of the support arm body for the at least one support arm piece which is positionable therein.

2. The lifting device according to claim 1, wherein the upper and lower pivot bearing lie in a mutual pivot axis which extends through the inner space of the support arm body.

3. The lifting device according to claim 2, wherein at least one of the upper and lower pivot bearing is formed as a pivot pin and a pivot axis which is formed by the pivot pin is interrupted between the support and the support arm body in the inner space of the support arm body.

4. The lifting device according to claim 1, wherein the upper pivot bearing is formed by an upper pivot pin and the support arm body is mounted to be hanging with respect to the upper support section using the upper pivot pin.

5. The lifting device according to claim 4, wherein the lower pivot bearing is formed by a lower pivot pin and the support arm body is guided to be aligned to the pivot axis on the lower support section using the lower pivot pin.

6. The lifting device according to claim 4, wherein the support arm body has a box-shaped housing which has a bore on an upper housing wall with which the upper pivot pin engages to receive the support arm body and the upper housing wall having a shoulder engages behind in the inner space of the support arm body.

7. The lifting device according to claim 3, wherein the upper pivot pin has a groove which is arranged above an upper side of the upper support section, with which a pivot pin retainer engages.

8. The lifting device according to claim 7, wherein the pivot pin retainer is formed to be plate-shaped, which has a U-shaped retaining section which engages with the groove of the upper pivot pin.

9. The lifting device according to claim 5, wherein the upper and lower pivot pins are each insertable from the inner space of the support arm body or from outside or optionally from inside or from outside into the bore on the upper and lower housing wall of the support arm body and into a corresponding bore in the upper and lower support section.

10. The lifting device according to claim 1, wherein at least one guide or sliding element is provided on at least two opposite housing walls of the support arm body, by which the first support arm piece is guided traversably in the support arm body.

11. The lifting device according to claim 1, wherein several support arm pieces are arranged telescopically in the support arm body.

12. The lifting device according to claim 11, wherein a stop to limit extension paths or retraction paths of the support arm pieces is provided on each of a front and rear end or region of the support arm piece.

13. The lifting device according to claim 5, wherein the upper and lower pivot pins have at least one lubricant supply which are accessible from the outside and comprise at least one lubricant channel which leads to a respective bearing surface.

14. The lifting device according to claim 1, wherein the support arm body has a roller guide on a lower housing wall which is to the front in an extraction direction of the support arm piece.

15. The lifting device according to claim 1, wherein at least one roller guide is provided on the at least one support arm piece, said roller guide supporting a retraction and extension movement and being rendered inoperative in the case of load receiving.

16. A lifting device for lifting and lowering vehicles, having a support which is movable up and down, on which at least one longitudinally adjustable support arm is mounted to be pivotable around a pivot axis on the support and a free end of the support arm is movable under the vehicle with respect to the support point of the vehicle, wherein the longitudinally adjustable support arm has a support arm body which receives at least one support arm piece which forms an extension in an extractable manner, wherein the support comprises an upper and lower support section with respect to which the support arm body is mounted rotatably using a pivot arrangement which is formed by an upper and lower pivot bearing which releases an inner space of the support arm body for the at least one support arm piece which is positionable therein, wherein at least one of the upper and lower pivot bearing is formed as a pivot pin and a pivot axis which is formed by the pivot pin is interrupted between the support and the support arm body in the inner space of the support arm body.

17. A lifting device for lifting and lowering vehicles, having a support which is movable up and down, on which at least one longitudinally adjustable support arm is mounted to be pivotable around a pivot axis on the support and a free end of the support arm is movable under the vehicle with respect to the support point of the vehicle, wherein the longitudinally adjustable support arm has a support arm body which receives at least one support arm piece which forms an extension in an extractable manner, wherein the support comprises an upper and lower support section with respect to which the support arm body is mounted rotatably using a pivot arrangement which is formed by an upper and lower pivot bearing which releases an inner space of the support arm body for the at least one support arm piece which is positionable therein, wherein at least one guide or sliding element is provided on at least two opposite housing walls of the support arm body, by which the first support arm piece is guided traversably in the support arm body.

* * * * *